US006290778B1

(12) United States Patent
Zugibe

(10) Patent No.: US 6,290,778 B1
(45) Date of Patent: Sep. 18, 2001

(54) METHOD AND APPARATUS FOR SONIC CLEANING OF HEAT EXCHANGERS

(75) Inventor: Kevin Zugibe, Pomona, NY (US)

(73) Assignee: Hudson Technologies, Inc., Pearl River, NY (US)

( * ) Notice: Subject to any disclaimer, the term of this patent is extended or adjusted under 35 U.S.C. 154(b) by 0 days.

(21) Appl. No.: 09/373,299

(22) Filed: Aug. 12, 1999

Related U.S. Application Data

(60) Provisional application No. 60/096,296, filed on Aug. 12, 1998.

(51) Int. Cl.[7] ..... B08B 3/12

(52) U.S. Cl. ..... 134/1; 134/227; 134/113; 134/166 C; 134/184

(58) Field of Search ..... 134/1, 22.1, 113, 134/166 C, 184

(56) References Cited

U.S. PATENT DOCUMENTS

| | | | | |
|---|---|---|---|---|
| 4,033,407 | | 7/1977 | Quintilliano | 165/95 |
| 4,071,078 | | 1/1978 | Padden | 165/27 |
| 4,120,699 | | 10/1978 | Kennedy et al. | 134/1 |
| 4,244,749 | | 1/1981 | Sachs et al. | 134/1 |
| 4,358,204 | | 11/1982 | Ellner | 366/118 |
| 4,365,487 | | 12/1982 | Dobney | 62/438 |
| 4,366,003 | | 12/1982 | Korte et al. | 134/18 |
| 4,372,787 | | 2/1983 | Fields et al. | 134/1 |
| 4,375,991 | | 3/1983 | Sachs et al. | 134/1 |
| 4,382,467 | | 5/1983 | Garrison et al. | 165/159 |
| 4,398,925 | | 8/1983 | Trinh et al. | 55/15 |
| 4,437,322 | | 3/1984 | Ertinger | 62/54 |
| 4,539,940 | | 9/1985 | Young | 122/32 |
| 4,551,041 | | 11/1985 | Coon et al. | 405/85 |
| 4,588,917 | | 5/1986 | Ratcliff | 310/316 |
| 4,645,542 | | 2/1987 | Scharton | 134/1 |
| 4,691,724 | * | 9/1987 | Garcia et al. | 134/184 |
| 4,705,054 | | 11/1987 | Fields | 134/57 R |
| 4,736,130 | | 4/1988 | Puskas | 310/316 |
| 4,747,449 | | 5/1988 | Nickell | 165/134.1 |
| 4,748,365 | | 5/1988 | Poupaert et al. | 310/316 |
| 4,750,547 | | 6/1988 | Sakamoto | 165/84 |
| 4,773,357 | | 9/1988 | Scharton et al. | 122/382 |
| 4,823,513 | * | 4/1989 | Marcus et al. | 134/1 |
| 4,858,681 | | 8/1989 | Sulzberger | 165/7 |
| 4,864,547 | | 9/1989 | Krsna | 367/137 |
| 4,966,177 | | 10/1990 | John et al. | 134/61 |
| 4,972,805 | | 11/1990 | Weems | 122/383 |
| 4,974,617 | | 12/1990 | Simon | 134/22.12 |
| 4,991,609 | | 2/1991 | Browning | 134/57 R |
| 5,025,215 | * | 6/1991 | Pirl | 324/220 |

(List continued on next page.)

OTHER PUBLICATIONS

Beck et al; "Megasonics Help'Stream'–line Sensitive Substrate Cleaning", Precision Cleaning, Jan. 1998, pp 15–19.
www.upcorp.com/explanation.
www.ij.net/GCU/tech.html.
Layton, Howard "Ultrasonic Frequencies Make a Clean Sweep", Precision Cleaning, Jan. 1998, pp 9–14.
www.bluewaveinc/com/reprint.htm.
www.caeblackstone.com/contents.html.
www.grecobrothers.com/hpdg.htm.

*Primary Examiner*—Randy Gulakowski
*Assistant Examiner*—Saeed Chaudhry
(74) *Attorney, Agent, or Firm*—Milde, Hoffberg & Macklin, LLP

(57) ABSTRACT

A method for cleaning a tube-in-shell heat exchanger, comprising removably inserting an ultrasonic transducer within the shell of the heat exchanger; providing a liquid medium within the shell of the heat exchanger; exciting the ultrasonic transducer to produce cavitational acoustic waves within the liquid medium; and repositioning the ultrasonic transducer with respect to a tube within the heat exchanger. The system preferably includes a control for controlling transducer excitation and transducer position. Closed loop control may be effected with fluid medium contamination sensor(s) and/or position sensor(s).

41 Claims, 3 Drawing Sheets

U.S. PATENT DOCUMENTS

| | | | |
|---|---|---|---|
| 5,031,410 | 7/1991 | Pizak et al. | 62/85 |
| 5,076,854 | 12/1991 | Honda et al. | 134/1 |
| 5,109,174 | 4/1992 | Shewell | 310/317 |
| 5,137,580 | 8/1992 | Honda | 134/1 |
| 5,190,664 | 3/1993 | Gallup et al. | 210/696 |
| 5,289,838 | 3/1994 | Odell | 134/166 R |
| 5,339,844 | 8/1994 | Stanford et al. | 137/107 |
| 5,413,168 | 5/1995 | Baum | 165/95 |
| 5,458,860 | 10/1995 | Morris et al. | 423/155 |
| 5,462,604 | 10/1995 | Shibano et al. | 134/1 |
| 5,467,791 | 11/1995 | Kato et al. | 134/166 |
| 5,479,783 | 1/1996 | Uchida | 62/101 |
| 5,496,411 | 3/1996 | Candy | 134/1 |
| 5,529,635 | 6/1996 | Odell | 134/1 |
| 5,653,282 | 8/1997 | Hackemesser et al. | 165/134.1 |
| 5,692,381 | 12/1997 | Garrett | 62/60 |
| 5,711,327 | 1/1998 | Fields | 134/105 |
| 5,777,860 | 7/1998 | Halbert | 363/34 |
| 5,834,871 | 11/1998 | Puskas | 310/316 |
| 5,931,173 * | 8/1999 | Schiele | 134/902 |

* cited by examiner

METHOD AND APPARATUS FOR SONIC CLEANING OF HEAT EXCHANGERS

The present application claims the benefit of priority from U.S. Provisional Patent Application Ser. No. 60/096,296 filed on Aug. 12, 1998.

FIELD OF THE INVENTION

The present invention relates to the field of sonic cleaning of surfaces, and more particularly to the field of cleaning chiller heat exchangers using sonic waves.

BACKGROUND OF THE INVENTION

It is known that the buildup of deposits and contaminants on the surface of heat exchangers reduces their efficiency, and that the removal of these deposits restores efficiency.

In the field of refrigeration and chillers, the evaporator heat exchanger is a large structure, containing a plurality of parallel tubes, within a larger vessel comprising a shell, through which refrigerant flows, absorbing heat and evaporating. Outside the tubes, an aqueous medium, such as brine, circulates and is cooled, which is then pumped to the process region to be cooled. Such an evaporator may hold hundreds or thousands of gallons of aqueous medium with an even larger circulating volume. The known process for cleaning the aqueous portion these heat exchangers involves flushing an aqueous cleaning fluid around the heat exchange pipes, hoping to dissolve or dislodge deposits. More aggressive cleaning involves dismantling the shell of the evaporator and manually cleaning the refrigerant tubes by scrubbing. This cleaning process is thus cumbersome and inefficient.

U.S. Pat. Nos. 4,437,322; 4,858,681; 5,653,282; 4,539,940; 4,972,805; 4,382,467; 4,365,487; 5,479,783; 4,244,749; 4,750,547; 4,645,542; 5,031,410; 5,692,381; 4,071,078; 4,033,407; 5,190,664; and 4,747,449 relate to heat exchangers and the like.

The operation of various pipes and tubes and vessels including heat exchangers is routinely impeded by the buildup of sedimentation in and around heat exchange surfaces and components causing restriction of flow and impediment of enthalpy or both. Devices using acoustic-type energy to resist or remove sedimentation have been suggested. In such devices, a portion of energy is imparted to tubes and other walls encountered and to molecules and particles in suspension or solution in the fluid. If the imparted energy density is less than the deposition energy of suspended or dissolved particles and/or the binding energy of deposited particles, deposition restrain and/or dislodgment of sediment particles will be less efficient in accordance with the laws of statistics. If the imparted energy density exceeds such sedimentation rate and/or binding energy, sedimentation will be prevented and existing sediment more rapidly dissipated.

The issue then becomes effectively and efficiently imparting the acoustic waves. The efficiency of prior art acoustic devices is limited, and, moreover, there is a limit to the power which can be applied to the transducer because of the so-called cavitation effect in the fluid and risk of damage. While composite wave devices have been suggested, these utilize resonance effects and produce resultant standing wave patterns which may leave areas untreated and subject to load and configuration variances.

U.S. Pat. Nos. 2,987,068; 3,640,295; and 3,295,596, expressly incorporated herein by reference, as well as British Pat. Nos. 1,456,664 and 1,385,750 each teach ultrasonic cleaning apparatuses which include a plurality of transducers affixed to a cleaning vessel or container for effecting ultrasonic cleaning of items inserted within the vessel or container. U.S. Pat. No. 3,240,963, expressly incorporated herein by reference, teaches a plurality of transducers movably mounted within a vessel for cleaning items disposed therein. Ultrasonic transducers are shown in U.S. Pat. No. 2,716,708, expressly incorporated herein by reference, and British Pat. No. 1,282,552. U. S. Pat. No. 3,371,233 discloses a multifrequency ultrasonic cleaning apparatus. U. S. Pat. No. 3,638,087, expressly incorporated herein by reference, discloses a gated power supply for sonic cleaners.

High pressure, low-frequency shock waves are used to unplug blocked pipes (Simon, U.S. Pat. No. 4,974,617, expressly incorporated herein by reference; Coon et al., U.S. Pat. No. 4,551,041, expressly incorporated herein by reference), and clean corrosion products and sedimentation from the interior walls of heat exchanger tubes (Scharton et al., U.S. Pat. No. 4,645,542, expressly incorporated herein by reference). Such techniques are, however, not suitable for cleaning the interior surfaces of elongated tubes for the purpose of degreasing or cleaning, due to the high pressures (up to 5,000 psi) of the shock waves and extended time periods required (1–24 hours).

It is known in the ultrasonic cleaning art that high peak or power bursts are necessary for aggressive cleaning or for cavitating liquids. The prior art provides various power burst controls for adjusting a duty cycle, amplitude and frequency of the transducer output, in addition to the pulse sequences and parameters.

U.S. Pat. No. 4,736,130, expressly incorporated herein by reference, relates to a multiparameter generator for ultrasonic transducers, which controls seven variables. These are: 1) the time duration of a power pulse train, which is followed by a 2) time period of no activity for degassing, 3) the time duration of individual power bursts during the power train period, 4) the time duration of periods of no activity between the individual power bursts, 5) the range of amplitude modulation of each power burst, 6) the mean transmitted frequency, and 7) a frequency modulation index.

In U.S. Pat. No. 4,398,925 Trinh et al., expressly incorporated herein by reference, relates to an ultrasonic transmitting apparatus for removing dissolved gas in a fluid. It is disclosed that the transmitted frequency is swept from 0.5 kHz to 40 kHz and that the ratio between the low and high frequency limit should be at least 10 times.

In U.S. Pat. Nos. 3,648,188, and 4,588,917, expressly incorporated herein by reference, relate to power oscillators with different resonant arrangements and positive feedback components to cause oscillation.

U.S. Pat. No. 4,864,547, expressly incorporated herein by reference, relates to a system for producing a soft start and means to vary the power to the transducer.

Several phase locked loop arrangements are described so that a resonant frequency of the transducer is locked onto by the drive electronics. U.S. Pat. No. 4,748,365, expressly incorporated herein by reference, is an example of this which describes means for searching for the load resonance point and then locking onto it.

U.S. Pat. No. 4,120,699, expressly incorporated herein by reference, relates to a method for acoustical cleaning of heat exchangers and the like.

U.S. Pat. Nos. 4,244,749 and 4,375,991, expressly incorporated herein by reference, relate to ultrasonic cleaning methods for heat exchangers.

U.S. Pat. No. 4,358,204, expressly incorporated herein by reference, relates to an ultrasonic method for cleaning ultraviolet lamps in a treatment chamber.

U.S. Pat. No. 4,366,003, expressly incorporated herein by reference, relates to a method for periodically cleaning out solid deposits from heat exchanger pipes.

U.S. Pat. No. 4,645,543, expressly incorporated herein by reference, relates to a method of pulse pressure cleaning the interior of heat exchanger tubes.

U.S. Pat. No. 4,750,547, expressly incorporated herein by reference, relates to a method for cleaning inner surfaces of heat-transfer tubes in a heat exchanger employing ultrasonic waves.

U.S. Pat. No. 4,773,357, expressly incorporated herein by reference, relates to a water cannon apparatus for cleaning tube bundle heat exchangers.

U.S. Pat. No. 4,974,617, expressly incorporated herein by reference, relates to a low frequency sonic method for clearing a liquid-filled pipe.

U.S. Pat. No. 4,991,609, expressly incorporated herein by reference, relates to an ultrasonic cleaning method.

U.S. Pat. No. 4,966,177, expressly incorporated herein by reference, relates to a method for ultrasonic cleaning of fuel rod tubes.

U.S. Pat. No. 4,972,805, expressly incorporated herein by reference, relates to a gas-pulse method and apparatus for removing foreign matter from heat exchanger tubesheets.

U.S. Pat. No. 5,076,854, expressly incorporated herein by reference, relates to a multifrequency hopping method for cleaning.

U.S. Pat. No. 5,109,174, expressly incorporated herein by reference, relates to an ultrasonic generator for a cleaning system.

U.S. Pat. No. 5,137,580, expressly incorporated herein by reference, relates to a alternating multifrequency ultrasonic cleaning system.

U.S. Pat. Nos. 5,289,838 and 5,529,635, expressly incorporated herein by reference, relate to methods for ultrasonically cleaning interior surfaces, for example, of tubes.

U.S. Pat. No. 5,339,844, expressly incorporated herein by reference, relates to a method for ultrasonic cleaning in liquid $CO_2$.

U.S. Pat. No. 5,413,168, expressly incorporated herein by reference, relates to a solvent-based method for cleaning heat exchangers.

U.S. Pat. No. 5,458,860, expressly incorporated herein by reference, relates to a sonic and solvent-based cleaning method.

U.S. Pat. No. 5,462,604, expressly incorporated herein by reference, relates to a method of driving an ultrasonic transducer for cleaning.

U.S. Pat. No. 5,467,791, expressly incorporated herein by reference, relates to an ultrasonic cleaning method.

U.S. Pat. No. 5,496,411, expressly incorporated herein by reference, relates to an ultrasonic vibration generator.

U.S. Pat. Nos. 5,711,327, 4,705,054 and 4,372,787, expressly incorporated herein by reference, relate to ultrasonic methods for cleaning radiators and the like.

U.S. Pat. No. 5,777,860, expressly incorporated herein by reference, relates to an ultrasonic frequency power supply.

The use of ultrasonics to enhance the cleaning effectiveness of solvents is well known. Ultrasonic techniques are particularly valuable when aqueous solvents are used, since aqueous solvents are intrinsically less effective than CFC. solvents. The object to be cleaned is placed in a bath containing a mixture of water or some other solvent. Ultrasonic waves agitate the mixture, inducing cavitation at sites where the localized pressure is low enough that the fluid can no longer support the sound wave. At typical ultrasonic frequencies, cavitation occurs at sound pressures of approximately 0.36 watt/cm$^2$ in water. The mechanical disruption and agitation of the fluid at the cavitation sites significantly enhances its effectiveness as a cleaner and degreaser.

While it is known to apply ultrasonic cleaning techniques to certain types of heat exchangers, such as coolers for nuclear power plants, these techniques are inapplicable to heating ventilation and air conditioning (HVAC) and process chillers, as access to the evaporator tubes is poor and the physical dimensions are smaller. Further, the biofouling of nuclear power plant heat exchangers is qualitatively different from the mineral and agglomerate deposits on the chiller tubes. Finally, the chiller evaporator is less robust than a power plant heat exchanger, and thus is not amenable to strenuous cleaning methods. Thus, any cleaning method which substantially risks damage to the chiller evaporator tubing is unacceptable.

In order to understand the mechanics of ultrasonics, it is necessary to first have a basic understanding of sound waves, how they are generated and how they travel through a conducting medium. The dictionary defines sound as the transmission of vibration through an elastic medium which may be a solid, liquid, or a gas. A sound wave is produced when a solitary or repeating displacement is generated in a sound conducting medium, such as by a "shock" event or "vibratory" movement. The displacement of air by the cone of a radio speaker is a good example of "vibratory" sound waves generated by mechanical movement. As the speaker cone moves back and forth, the air in front of the cone is alternately compressed and rarefied to produce sound waves, which travel through the air until they are finally dissipated. There are also sound waves which are created by a single "shock" event. An example is thunder which is generated as air instantaneously changes volume as a result of an electrical discharge (lightning). Another example of a shock event might be the sound created as a wooden board falls with its face against a cement floor. Shock events are sources of a single compression wave which radiates from the source and may also include a bulk movement component.

In elastic media such as air and most solids, there is a continuous transition as a sound wave is transmitted. In non-elastic media such as water and most liquids, there is continuous transition as long as the amplitude or "loudness" of the sound is relatively low. As amplitude is increased, however, the magnitude of the negative pressure in the areas of rarefaction eventually becomes sufficient to cause the liquid to fracture because of the negative pressure, causing a phenomenon known as cavitation. Cavitation "bubbles" are created at sites of rarefaction as the liquid fractures or tears because of the negative pressure of the sound wave in the liquid. As the wave fronts pass, the cavitation "bubbles" oscillate under the influence of positive pressure, eventually growing to an unstable size. Finally, the violent collapse of the cavitation "bubbles" results in implosions, which cause shock waves to be radiated from the sites of the collapse and are also associated with "jets" of medium. The collapse and implosion of myriad cavitation "bubbles"; throughout an ultrasonically activated liquid result in the effect commonly associated with ultrasonics. It has been calculated that temperatures in excess of 10,000° F. (or about 5,000° C.) and pressures in excess of 10,000 PSI (or about 500 atm) are generated at the implosion sites of cavitation bubbles.

Because of the very short duration of the bubble expansion and collapse cycle, the liquid surrounding the bubble quickly absorbs the heat and the area cools quickly. As a result, the tank and liquid becomes only warm and does not heat up due to the introduction of parts during the cleaning process. Effectively, in an ultrasonic cleaning system, the ultrasonic energy is concentrated near surfaces or discontinuities in the path of the sonic wave, resulting in interference between the incident and reflected portions of the wave.

The implosion event, when it occurs near a hard surface, changes the bubble into a jet about one-tenth the bubble size, which travels at speeds up to 400 km/hr toward the hard surface. With the combination of pressure, temperature, and velocity, the jet frees contaminants from their bonds with the substrate. Because of the inherently small size of the jet and the relatively large energy, ultrasonic cleaning has the ability to reach into small crevices and remove entrapped soils very effectively.

Cavitation and implosion as a result of ultrasonic activity displace and remove loosely held contaminants such as dust from surfaces. For this to be effective, it is necessary that the coupling medium be capable of wetting the particles to be removed.

Some contaminants are comprised of insoluble particles loosely attached and held in place by ionic or cohesive forces. These particles need only be displaced sufficiently to break the attractive forces to be removed.

Contaminations can also, of course, be more complex in nature, consisting of combination soils made up of both soluble and insoluble components. The effect of ultrasonics is substantially the same in these cases, as the mechanical micro-agitation helps speed both the dissolution of soluble contaminants and the displacement of insoluble particles. Ultrasonic activity has also been demonstrated to speed or enhance the effect of many chemical reactions. This is probably caused mostly by the high energy levels created as high pressures and temperatures are created at the implosion sites. It is likely that the superior results achieved in many ultrasonic cleaning operations may be at least partially attributed to the sonochemistry effect.

In the field of sonic cleaning, the range of useful frequencies extends from sonic and ultrasonic (above 18 kHz to about 100 kHz) to megasonic (500 kHz to 1 MHz and beyond). Typically, the ultrasonic systems are employed for gross cleaning, while megasonic systems are employed for fine cleaning or cleaning of delicate parts. See, Beck, Mark and Venerbeck, Richard B., "Megasonics Help 'Stream'-line Sensitive Substrate Cleaning", Precision Cleaning, January, 1998, pp. 15–19.

Acoustic cavitation is generally regarded as the principle mechanism of particle removal in acoustic cleaning. In an acoustic field, a bubble or cavity in the liquid can be created when the liquid pressure momentarily drops below the vapor pressure as a result of pressure oscillation. There are four methods of producing cavitation.

The pressure oscillations which produce acoustic cavitation cause bubbles to contract and expand. Gas from the liquid diffuses into the bubble upon expansion, and leaves the bubble during contraction. When the bubble reaches a size that can no longer be sustained by its surface tension, the bubble will collapse and the intensity of this collapse on a substrate surface is related to the type of acoustic cavitation produced. It is noted that near the point of collapse, there is a non-linearity, which may be explained by physical effects. In order to form a gas, a heat of vaporization must be added. When the bubble collapses, the latent heat of vaporization is released. Thus, ultrasonic cleaning depends on cavitation of the liquid media with ultimate collapse of the bubbles, which release shock waves, and small jets of media atoms. Depending on the proximity of the cavitation to the surface, the cleaning effect is either by the vibrations, amplified by the cavitation effect and conducted by the medium, or directly by the jets involved in the cavitation.

During the negative pressure portion of the sound wave, the liquid is thus torn apart and cavitation bubbles start to form. As a negative pressure develops within the bubble, gasses dissolved in the cavitating liquid start to diffuse across the boundary into the bubble. As negative pressure is reduced due to the passing of the rarefaction portion of the sound wave and atmospheric pressure is reached, the cavitation bubble starts to collapse due to its own surface tension. During the compression portion of the sound wave, any gas which diffused into the bubble is compressed and finally starts to diffuse across the boundary again to re-enter the liquid. This process, however, is never complete as long as the bubble contains gas since the diffusion out of the bubble does not start until the bubble is compressed. And once the bubble is compressed, the boundary surface available for diffusion is reduced. As a result, cavitation bubbles formed in liquids containing (noncondensable) gas do not collapse all the way to implosion but rather result in a small pocket of compressed gas in the liquid. This phenomenon can be useful in degassing liquids. The small gas bubbles group together until they finally become sufficiently buoyant to come to the surface of the liquid.

Liquids containing dissolved gas thus have suppressed cavitation intensity, because the gas diffuses into cavitation bubbles formed during the negative pressure portion of the sound wave, and cushions the implosion of the bubble during the positive portion of the wave. As a result, there is no violent implosion. Dissolved gas can be eliminated from liquids by applying ultrasonic energy intermittently, or by heating the liquid. During intermittent excitation, gas bubbles will form as the energy is applied and then float to the surface when it is turned off. As temperature is increased, liquids are able to hold less dissolved gas. It is a good idea to fill a cleaning tank with liquid that is at or near the operating temperature when possible.

There are two types of acoustic cavitation: transient and stable (or controlled). Transient cavities exist for a few cycles, and are followed by a rapid and violent collapse, or implosion, that produces very high local temperatures. Ultrasonic cleaning frequencies, typically between 20 and 350 kHz, transform low-energy/density sound waves into high-energy/density collapsing bubbles, producing transient acoustic cavitation. Transient acoustic cavitation can cause damaging surface erosion in more sensitive substrates. In routine cleaning operations of uncontrolled mechanisms and under poorly controlled conditions, such damage would be very undesirable.

Megasonic cleaning systems typically use transducers exploiting the piezoelectric effect at high frequencies between 700 and 1000 kHz to remove submicron particles from substrates. Cleaning is accomplished by exciting a ceramic piezoelectric crystal with a high-frequency AC voltage, causing the ceramic material to change dimension, or vibrate. These vibrations are transmitted by the ceramic transducer to produce megasonic waves in the cleaning fluid. Megasonic frequencies are typically exploited to produce stable acoustic cavitation, which is characterized by mostly small, gas-filled cavities. Stable cavitation bubbles have less time to grow and are smaller, resulting in a less vigorous collapse than in transient cavitation. The implosion associated with these smaller, gas-filled bubbles is less likely to produce surface damage. Thus, megasonic cavitation is better suited for sensitive substrate surfaces, but is less effective in cleaning grossly contaminated surfaces.

Ultrasonics simultaneously cleans all sides of a submerged part, while megasonics cleans only the surfaces of the part facing the acoustic stream formed by the piezoelectric crystal. This is due to the highly directional nature of the megasonic waves and their absorption by the media, resulting in line-of-sight action.

In an acoustic cleaning system working in continuous mode, sound waves are reflected from substrate surfaces, exterior containment walls, and the free surface (is any) of the liquid medium. The pressure amplitude, or sonic power, required to achieve controlled cavitation and acoustic streaming depends on pulse width, dissolved gas content in the cleaning fluid, and power input. The threshold pressure needed to initiate cavitation has been found to be a strong function of the pulse width and the duty cycle of the power input into the transducer. The increase of cavitation threshold pressure with a decrease in pulse width may be related to the time needed for a bubble to grow by rectified diffusion. With short pulses, bubbles may not have enough time to grow transient cavities. Megasonics cleaning, therefore, is optimized by pulsing the input power, thus providing effective particle removal and enhanced control over cavitation.

Acoustic streaming is the time-independent fluid motion generated by a sound field. This motion, caused by the loss of acoustic momentum by attenuation or absorption of a sound beam, enhances particle dissolution and transports detached particles away from surfaces, decreasing particle redeposition. Since the absorption coefficients for high (megasonic) frequency sonic waves in a liquid is much greater than low (ultrasonic) frequency sonic waves, streaming is a quantitatively more important effect in megasonic systems.

Cleaning activity depends not only on the local sound intensity at the substrate surface, but also on the bulk motion of the fluid, which carries removed particles away from substrates and reduces the surface boundary concentration of dissolved contaminants. In a closed environment, bulk motion is produced by acoustic streaming. Stable cavitation bubbles also influence the bulk flow through buoyancy forces and microscopic flow through acoustic streaming.

Fluid velocity in a stream is a function of the velocity of the fluid produced by acoustic waves, and the velocity of acoustic streaming. Pressure is also divided into two parts: the acoustic pressure generated by acoustic waves and the hydraulic pressure caused by acoustic streaming.

The acoustic waves used in sonic cleaning may either slide, roll, or lift a particle from its initial position on a substrate, depending on the size and shape of the particle, as well as the nature of the hydrodynamic force being applied.

In varying degrees, limited frequency sweep has always been inherent in the operation of ultrasonic cleaning equipment. Variations in liquid level, solution temperature and workload configuration tend to de-tune the system and, for this reason, ultrasonic generators have incorporated feedback circuits of one sort or another to neutralize the effect of these variables. These same feedback circuits or loops have also served to allow the generator to compensate for minor variations in the resonant frequencies of individual transducers within a given tank assembly. See, Layton, Howard M., "Ultrasonic Frequencies Make a Clean Sweep", Precision Cleaning, January 1998, pp. 9–14.

There are seven major concerns related to successful ultrasonic cleaning: time, temperature, chemistry, proximity of surface to be cleaned to the transducer, ultrasonic output frequency, watts per gallon, and loading of the cleaning system.

It is believed that high frequencies penetrate more and lower frequencies are more aggressive. The majority of the ultrasonic cleaning that is done in industrial applications uses 40 kHz as the base frequency. Lower frequencies, such as 20–25 kHz, are used for large masses of metal where ultrasonic erosion is of little consequence. The large metal mass dampens or absorbs a great amount of the ultrasonic cleaning power.

Most industrial ultrasonic cleaning systems use watt density from 50–100 Watts per gallon. However, there is what is known as "the large tank phenomenon", which indicates that fluid volumes over 50 gallons usually require only about 20 watts per gallon.

Maximizing cavitation of the cleaning liquid is obviously very important to the success of the ultrasonic cleaning process. Several variables affect cavitation intensity. Temperature is the most important single parameter to be considered in maximizing cavitation intensity. This is because so many liquid properties affecting cavitation intensity are related to temperature. Changes in temperature result in changes in viscosity, the solubility of gas in the liquid, the diffusion rate of dissolved gasses in the liquid, and vapor pressure, all of which affect cavitation intensity. In pure water, the cavitation effect is maximized at approximately 160° F.

Temperature and chemistry are closely related. The operating temperature should be at least about 6° F. below the boiling point of the liquid, although other considerations control the operating temperature. The containment pressure may be varied to control cavitation effects as well.

In general, liquids with higher surface tension exhibit higher cavitation intensities. This is thought to be because the higher surface tension results in greater energy being released as cavitation bubbles implode. More viscous liquids require more energy to cavitate. As viscosity is increased (perhaps to that of motor oil) ultrasonic cavitation is no longer possible using normal ultrasonic techniques.

The viscosity of a liquid may thus be minimized for increased cavitation effect. Viscous liquids are sluggish and cannot respond quickly enough to form cavitation bubbles and violent implosion. The viscosity of most liquids is reduced as temperature is increased.

For most effective cavitation, the cleaning liquid must contain as little dissolved gas as possible. Gas dissolved in the liquid is released during the bubble growth phase of cavitation and prevents its violent implosion which is required for the desired ultrasonic effect. The amount of dissolved gas in a liquid is reduced as the liquid-temperature is increased.

The diffusion rate of dissolved gasses in a liquid is increased at higher temperatures. This means that liquids at higher temperatures give up dissolved gasses more readily than those at lower temperatures, which aids in minimizing the amount of dissolved gas in the liquid.

A moderate increase in the temperature of a liquid brings it closer to its vapor pressure, meaning that vaporous cavitation is more easily achieved. Vaporous cavitation, in which the cavitation bubbles are filled with the vapor of the cavitating liquid, is the most effective form of cavitation. As the boiling temperature is approached, however, the cavitation intensity is reduced as the liquid starts to boil at the cavitation sites and at the transducers.

Cavitation intensity is directly related to Ultrasonic Power at the power levels generally used in ultrasonic cleaning systems. As power is increased substantially above the cavitation threshold, cavitation intensity levels off and can only be further increased through the use of focusing techniques. Therefore, acoustic lenses and reflectors and phased array transducers may be employed.

Cavitation intensity is inversely related to Ultrasonic Frequency. As the ultrasonic frequency is increased, cavitation intensity is reduced because of the smaller size of the cavitation bubbles and their resultant less violent implosion. The reduction in cavitation effect at higher frequencies may be overcome by increasing the ultrasonic power.

As ultrasonic frequency is increased, more power must be applied to maintain the same cavitation intensity. This is because at higher frequencies, relatively fewer sites are present which can become nuclei for cavitation bubbles. The higher the frequency, the smaller the nucleus for cavitation must be. Fewer cavitation bubbles of a smaller average size result in less cavitation intensity overall. Most ultrasonic cleaning equipment operates at frequencies between 21 and 45 kHz. Although a variation of frequency within this relatively narrow range seldom has a dramatic effect on cleaning, it may occasionally be considered as a variable in achieving maximum cleaning. Cases where it may be important are these where every small area must be penetrated and where the parts being cleaned may be frequency sensitive.

Various effects are produced by changing the speed and magnitude of a frequency modulation of the acoustic wave. The frequency may be modulated from once every several seconds to several hundred times per second with the magnitude of variation ranging from several hertz to several kilohertz for ultrasonic waves and correspondingly increased modulation for megasonic waves. Sweep may be used to prevent damage to delicate parts or to reduce the effects of standing waves. A combination of sweep and pulse operation may also be found especially useful in facilitating the cavitation of various organic solvents. Frequency hopping according to a random or pseudorandom pattern or other techniques to provide varying interference patterns to assure complete surface treatment may be employed.

The percentage of time that the ultrasonic energy is on may also be changed to produce varied results. At slower pulse rates, more rapid degassing of liquids occurs as coalescing bubbles of air are given an opportunity to rise to the surface of the liquid during the time the ultrasonic energy is off. At more rapid pulse rates the cleaning process may be enhanced as repeated high energy "bursts" of ultrasonic energy occur each time the energy source is turned on.

Various effects are produced by changing the speed and magnitude of the frequency modulation. The frequency may be modulated from once every several seconds to several hundred times per second with the magnitude of variation ranging from several hertz to several kilohertz. Sweep may be used to prevent damage to extremely delicate parts or to reduce the effects of standing waves in cleaning tanks.

In order to produce the positive and negative pressure waves in the medium, a mechanical vibrating device is required. Typical ultrasonic manufacturers make use of a diaphragm attached to high-frequency transducers. The transducers, which vibrate at their resonant frequency due to a high-frequency electronic generator source, induce amplified vibration of the diaphragm. This amplified vibration is the source of positive and negative pressure waves that propagate through the liquid medium.

There are two types of ultrasonic transducers used in the industry, piezoelectric and magnetostrictive. Both have the same functional objective, but the two types have dramatically different performance characteristics.

Piezoelectric transducers are made up of several components. The ceramic (usually lead zirconate) crystal is sandwiched between two strips of tin. The ultrasonic transducers preferably operate between 18 kHz and 80 kHz. Other suitable piezoelectric transducer materials include lithium niobate, lithium tantalate, barium sodium niobate, bismuth germanate, lead titanate zirconate, and barium titanate. When voltage is applied across the strips it creates a displacement in the crystal, known as the piezoelectric effect. When these transducers are mounted to a diaphragm (wall or bottom of the tank), the displacement in the crystal causes a movement of the diaphragm, which in turn causes a pressure wave to be transmitted through the liquid medium in the tank. Because the mass of the crystal is not well matched to the mass of the stainless steel diaphragm, an intermediate aluminum block is used to improve impedance matching for more efficient transmission of vibratory energy to the diaphragm. The assembly is inexpensive to manufacture due to low material and labor costs. This low cost makes piezoelectric technology desirable for ultrasonic cleaning. However, piezoelectric transducers have several shortcomings.

The most common problem is that the performance of a piezoelectric unit deteriorates over time. This can occur for several reasons. The crystal tends to depolarize itself over time and with use, which causes a substantial reduction in the strain characteristics of the crystal. As the crystal itself expands less, it cannot displace the diaphragm as much. Less vibratory energy is produced, with a corresponding decrease in cavitation. Additionally, piezoelectric transducers are often mounted with an epoxy adhesive, which is subject to fatigue at the high frequencies and high heat generated by the transducer and solution. The epoxy bond eventually loosens, rendering the transducer useless. The capacitance of the crystal also changes over time and with use, affecting the resonant frequency and causing the generator to be out of tune with the crystal resonant circuit.

Although the piezoelectric transducers utilize an aluminum block insert to improve impedance matching (and therefore energy transfer into the radiating diaphragm), they still have relatively low mass. This low mass limits the amount of energy transfer into the medium (as can be seen from the basic equation for kinetic energy, $e=\frac{1}{2} mv^2$). Due to the low mass of the piezoelectric transducers, a thin diaphragm must be used. A thick plate simply will not flex (and therefore cause a pressure wave) given the relatively low energy output of the piezoelectric transducer. However, there are several problems with using a thin diaphragm. A thin diaphragm driven at a certain frequency tends to oscillate at the upper harmonic frequencies as well, which creates smaller implosions. Another problem is that cavitation erosion, a common occurrence in ultrasonic cleaners, can wear through a thin-wall diaphragm. Once the diaphragm is penetrated, the solution will damage the transducers and wiring, leaving the unit useless and requiring major repair expense.

Magnetostrictive Transducers are known for their ruggedness and durability in industrial applications. Zero-space magnetostrictive transducers consist of nickel laminations attached tightly together with an electrical coil placed over the nickel stack. When current flows through the coil it creates a magnetic field. This is analogous to deformation of a piezoelectric crystal when it is subjected to voltage. When an alternating current is sent through the magnetostrictive coil, the stack vibrates at the frequency of the current.

The nickel stack of the magnetostrictive transducer is silver brazed directly to the resonating diaphragm. This has several advantages over an epoxy bond. The silver braze creates a solid metallic joint between the transducer and the diaphragm that will never loosen. The silver braze also efficiently couples the transducer and the diaphragm together, eliminating the damping effect that an epoxy bond creates. The use of nickel in the transducers means there will be no degradation of the transducers over time; nickel maintains its magnetostrictive properties on a constant level throughout the lifetime of the unit. Magnetostrictive transducers also provide more mass, which is a major factor in the transmission of energy into the solution in the ultrasonic tank. Zero-space magnetostrictive transducers have more mass than piezoelectric transducers, so they drive more power into the medium, and this makes them less load-sensitive than piezoelectric systems.

Magnetostrictive transducers utilize the principle of magnetostriction in which certain materials expand and contract when placed in an alternating magnetic field. Alternating electrical energy from the ultrasonic generator is first converted into an alternating magnetic field through the use of a coil of wire. The alternating magnetic field is then used to induce mechanical vibrations at the ultrasonic frequency in resonant strips of nickel or other magnetostrictive material which are attached to the surface to be vibrated. Because magnetostrictive materials behave identically to a magnetic field of either polarity, the frequency of the electrical energy applied to the transducer is ½ of the desired output frequency. Magnetostrictive transducers were first to supply a robust source of ultrasonic vibrations for high power applications such as ultrasonic cleaning.

Because of inherent mechanical constraints on the physical size of the hardware as well as electrical and magnetic complications, high power magnetostrictive transducers seldom operate at frequencies much above 20 kilohertz. Piezoelectric transducers, on the other hand, can easily operate well into the megahertz range. Magnetostrictive transducers are generally less efficient than their piezoelectric counterparts. This is due primarily to the fact that the magnetostrictive transducer requires a dual energy conversion from electrical to magnetic and then from magnetic to mechanical. Some efficiency is lost in each conversion. Magnetic hysteresis effects also detract from the efficiency of the magnetostrictive transducer.

A radiating diaphragm that uses zero-space magnetostrictive transducers is usually 5 mm (3/16 in.) or greater in thickness, eliminating any chance for cavitation erosion wearthrough. Heavy nickel stacks can drive a plate of this thickness and still get excellent pressure wave transmission into the aqueous solution.

The magnetostrictive transducer is not as efficient as a piezoelectric transducer. That is, for a given voltage or current displacement, the piezoelectric transducer will exhibit more deflection than the magnetostrictive transducer. However, the efficiency of concern should be that of the entire transducing system, including not only the transducer but also the elements that make up the transducer, as well as the diaphragm. It is the inferior mounting and impedance matching of a piezoelectric-driven diaphragm that reduces its overall transducing efficiency relative to that of a magnetostrictive transducer.

The ultrasonic generator converts a standard electrical frequency of, e.g., 50 or 60 Hz into the high frequencies required in ultrasonic transmission, generally in the range of 18 to 80 kHz, but which may extend from sonic frequencies, especially in combination with ultrasonic frequencies, to about 100 kHz. Many of the better generators today use advanced technologies such as sweep frequency, harmonic generation, and autofollow circuitry. Frequency sweep circuitry drives the transducers between a bandwidth slightly greater and slightly less than the center frequency. For example, a transducer designed to run at 30 kHz will be driven by a generator that sweeps between 29 and 31 kHz. This technology eliminates the standing waves and hot spots in the tank that are characteristic of older, fixed-frequency generators. Autofollow circuitry is designed to maintain the center frequency when the medium is subjected to varying load conditions. With autofollow circuitry, the generator matches electrically with the mechanical load, providing optimum output at all times to the ultrasonic transducer.

See, Ultrasonic Cleaning, Tool and Manufacturing Engineers Handbook, Vol. 3, Materials, Finishing, and Coating, C. Wick and R. F. Veilleux, Ed., Society of Manufacturing Engineers, 1985, p 18–20 to 18–24; F. J. Fuchs, Ultrasonic Cleaning, Metal Finishing Guidebook and Directory, Elsevier Science, 1992, p 134–139; See, "Ultrasonic Cleaning", published in the ASM Handbook, Vol. 5, Surface Engineering, p 44–47, copyright 1994, ASM International, Materials Park, Ohio 44073-0002. See also www.upcorp.com/explanation; www.ij.net/GCU/tech.html; www.bluewaveinc.com/reprint.htm; www.caeblackstone.com/contents.html (and linked pages). See also www.grecobrothers.com/hpdg.htm.

Applying a square wave signal to an ultrasonic transducer results in an acoustic output rich in harmonics. The result is a multi-frequency cleaning system which vibrates simultaneously at several frequencies which are harmonics of the fundamental frequency. Multi-frequency operation offers the benefits of all frequencies combined, although the acoustic power is spread over a wide band.

Basically, the cavitation threshold I can be determined by the following formula:

$$Ic=[(0.707)\times10^{6}\ P_c]^2\times10^{-7}=0.3\ P_c\ \text{Watt/cm}^2/\rho C$$

Where $P_c$ equals the peak pressure of sound wave causing cavitation per atmosphere, where ρ equals one gram/cm$^3$, and C equals $1.5\times10^5$ cm/second. Therefore, a cavitation threshold at one atmosphere is equivalent to a plane wave intensity of 0.3 watts per cm$^2$. With 0.3 watts/cm$^2$ being the plane wave threshold, the desired power level radiated from the ultrasonic cleaning apparatus would be between 0.5 to 2 watts cm$^2$ to insure that cavitation is taking place. It is interesting to note that pressure increases the effectiveness of ultrasonic cleaning up to 7 or 8 atmospheres. As a result, the farther down the ultrasonic cleaning apparatus 10 is employed, the more effective the cleaning will be, quite the converse of the cleaning problems which are encountered through the use of mechanical scraping or brushing. In fact, if the pressure is increased the power level under certain circumstances can be reduced.

SUMMARY OF THE INVENTION

The present invention provides a system and method for the ultrasonic cleaning a tube bundle of a tube in shell heat exchanger. These systems are used, for example, in HVAC, industrial processes, and other systems. A particular heat exchanger of interest is an evaporator unit in a chiller system.

According to one aspect of the invention, the exterior surfaces of heat exchanger tubes in the bundle are cleaned or deposits by the use of ultrasonic waves induced by a transducer or set of transducers disposed within the shell. These transducers are introduced through modified couplers for flow through the exterior space, allowing the transducers to be introduced into the space around the tubes, especially during a cleaning cycle. According to one embodiment, an ultrasonic probe is inserted through a special coupler into the secondary heat exchange fluid space, and thereby moved to direct sonic energy to portions of the exterior of the refrigerant heat exchange tubing. An aqueous medium may be continuously flowing in the heat exchanger, thus flushing contaminants away. By using a special coupler, the tube in shell heat exchanger need not be specially designed or modified, allowing cleaning of legacy systems.

The probe may be, for example, a magnetostrictive transducer within a cylindrical body, having an axially extending member from which acoustic waves are emitted. This probe is similar in design to a dentist's cleaning system. When submerged, the axially extending member will generate acoustic waves which propagate radially outward, thus providing poor localization to the intended site of action. However, when this probe is close or physically in contact with the tube surface, the energy density is sufficient to generate localized cavitation and clean the tube surface. Depending on the positioning system available, this probe may be positioned around the entire exterior of the tube bundle, and may be able to reach certain inner tube surfaces.

In order to provide more output power and to simultaneously clean greater surface areas, an array of transducers is provided. This array is inserted through the modified fitting and disposed between the shell and outer tubes of the bundle. Each transducer of the array is provided along a linear or rectangular (concave cylindrical) array with an emitting diaphragm surface, facing the tube bundles. The power for the array is provided through a cable, which may also be mechanically rigid to allow use of the cable to position the transducer. The location of the transducer within the shell may be monitored in a number of ways, including a simple sonic or electromagnetic transmission through the shell wall.

Because the tube bundle is regularly disposed within the shell, it is also possible to provide mechanized and automated "crawling" of the transducer around the tube bundle, sequentially treating regions both axially and radially displaced from an original position.

Alternately or additionally to the directed probe, an array of ultrasonic transducers may be inserted into the heat exchanger though the coupler, and excited to produce cavitational acoustic waves in the bulk of the fluid.

The preferred embodiment of the coupler comprises an elbow coupler with an access plate over the bend. Normally, the plate is fastened with bolts and a gasket to seal the elbow. During cleaning, a rubber boot replaces the plate, with the ultrasonic transducer or a cable therefore, allowing repositioning of the transducer during cleaning.

According to another aspect of the invention, a flush cycle is instituted using a refrigerant in the normally aqueous space, to act as a solvent for any grease or oil. Since the cleaning process is typically performed by refrigeration engineers, and the heat exchanger is normally subjected to refrigerants, the use and recapture of the refrigerant for this purpose is acceptable. In this case, however, a two or more phase flush is employed, for example a first organic solvent phase and a second aqueous solvent phase. The aqueous solvent may include chelators, scale inhibitors, detergents, and the like. The ultrasonic cleaning system may be active during one or both types of cleaning cycles.

As is known, the ultrasonic transducer is properly disposed and generates sufficient power to cause effective cavitation in the region of the surface contamination on the heat exchanger tubes, without causing damage thereto. As discussed below, a shear cleaning action may also be an important component of ultrasonic cleaning.

The ultrasonic transducer may be manually or automatically positioned. In order to properly position the transducer, a camera may be provided to guide the probe, in the manner of an endoscope. The probe may also be guided by a random search algorithm which finds and holds a position while detecting contamination in the effluent medium (indicative of cleaning) as a result of the sound. When the amount of contaminants falls below a threshold, the probe is moved. In "searching" the heat exchanger with the ultrasonic transducer, once an efficient cleaning orientation is identified, the probe may be moved or displaced axially along the length of the tubes to clean the entire length thereof before being reposition to a different orientation.

Another means to determine the requirement for descaling of the tubing is by providing a thermal differential between the heat exchanger tubing and the external space. Scale or contamination on the tubing will reduce heat transfer and thus reduce the measured temperature differential between the external surface (with deposits) and the bulk of the fluid in the external space. Clean tubes will have a relatively large temperature differential. Therefore, a simple thermal sensor system will define the need for treatment and cleaning of a tube or portion thereof. It is noted that the thermal transfer capacity of the heat exchanger may be measured during the cleaning operations, and when the system is operating at specified capacity, the cleaning cycle may be completed. It is noted that the external space of the evaporator has significant tolerance for impurities and deposits, and a high degree of cleanliness is not required. However, as the cost of running the process varies with the efficiency of the system, there is a significant advantage to removing any deposits, especially if this may be done relatively quickly with little risk of system damage.

Thus, one aspect of the invention is to provide an adaptive ultrasonic cleaning system which senses the progress of the cleaning and restores system efficiency.

In order to reach the middle tubes of the tube bundle in the heat exchanger, the ultrasonic waves must pass around the external tubes in the bundle, as well as any baffles which may be present. Since the exact configuration of tubes in the bundle may not be known before inspection, it is not possible to assure access by the ultrasonic probe. Therefore, the cleaning cycle relies on dispersion of the acoustic waves through the medium in the external compartment of the heat exchanger, to reach the innermost crevices. Advantageously, this is a property of acoustic waves, especially in the lower range of the ultrasonic spectrum, i.e., 18–30 kHz.

One possible transducer configuration includes a phased array transducer system, which is inserted through the fluid conduit, and which is relatively flat when deployed. Therefore, the transducer array will fit between the tube bundle and the wall of the outer shell. In this case, the power output of each transducer element may be less than that of a single optimized transducer, and, in fact, the output of the entire array may be lower than that of a single optimized transducer without substantial design constraints. However, since a phased array allows "focusing" the ultrasound energy, or otherwise closely control the energy distribution. In this manner, the tube bundle may be cleaned using ultrasonic energy.

It is also possible to insert ultrasonic generators into the lumen of the heat exchanger tubes, seeking to propagate ultrasonic waves through the walls thereof. In this case, a transducer may be fed through each tube individually. However, it is noted that access to the individual tubes may be restricted, so that such individual treatments may not be feasible. Further, the tubes themselves are not optimized to conduct ultrasonic waves therethrough, and thus may be inefficient.

In order to treat extensive surfaces of the heat exchanger tubing, it is often useful to employ simultaneous emission of acoustic waves from a plurality of transducers. Advantageously, these waves interact, such that regions of constructive interference have augmented cavitation. In this case, the mechanical configuration and/or electronic transducer excitation may be modified to incrementally displace the cavitation loci along the heat exchanger tube surfaces. Further, where the various acoustic waves differ slightly in frequency, there will be a "beat frequency" having a wavelength longer than each emitted frequency, which will represent the distance between constructive interference loci. Thus, by changing the frequency and/or phase of the waves, or the physical locations of the transducers even slightly, large areas of surface may be cleaned.

The spatial progression and successive time interval of the augmented waves will cause a continuous sweeping action over the surface to be cleaned and excite the activity of sedimentation particles in order to resist sedimentation. The variation in intensity and frequency of the resulting augmented waves will cause a cleaning action even in irregular surfaces.

The acoustic wave signal frequencies can be any suitable acoustic wave frequency, e.g., frequencies in the supersonic and ultra-sonic frequency range. Any number of transducers may be employed, suitably spaced, to propagate a plurality of opposing acoustic wave trains through the vessel fluid. Utilizing the constructive interference phenomenon permits energy densities in the augmented wave fronts that are higher than the cavitation energy level, which is the limiting maximum intensity at the transducer interface coupling. A plurality of acoustic wave trains, the intensity of each being below the cavitation level, can, in opposition, constructively interfere to form an augmented wave front, having a much higher intensity than any one of the individual acoustic wave trains.

The ultrasonic frequency generator may be of any known type which facilitates the cleaning operation, and indeed, it is contemplated that a commercially available generator may be used, although a custom generator may provide some advantages according to the present invention.

The generator(s), for example, produces sets of power trains, each formed of a sequence of power bursts of an ultrasound signal having a variable amplitude and a variable frequency. The power bursts are provided with controllable durations and are separated from one another by controllable quiet times. A cavitation density function generator controls the amplitude of the power bursts. The power trains are provided with controlled durations, and variable degas time durations are included between sequences of bursts of the ultrasonic signals. A further function generator is used to control the frequency of the signal, thus providing a swept frequency burst. A controller is provided for setting the center frequency of the swept signal. The generator thus provides a waveform with a number of controllable parameters which may be set to conform to any operational criteria. It is noted that by using transducer arrays or separate transducers, the ultrasonic energy may be provided or focussed in one region while another region is "quiet", for example to allow gas bubbles to dissipate. Therefore, even though the local ultrasonic excitation may be intermittent, the power output of the generator may be constant, though in varying spaces.

Various sets of values for the parameters may be stored, and that, by automatic or manual selection of an appropriate set of parameter values, each of the control devices used therein may be controlled in order to provide a particular waveform to the transducer. Thus, a program may include successive power trains of different characteristics and having different parameter values. Additionally, a closed loop control system is contemplated which, under control of a microprocessor for example, may automatically vary the parameters provided by the inventive arrangement to the waveform in order to optimize the variable values for a particular process being performed. Alternatively, one or more of the parameters may be set to optimum constants, or fixed functions, corresponding to a particular class of applications. Others of the parameters may be adjusted to optimize performance of a specific application within the class of applications.

According to another aspect of the invention, the interior space of the heat exchanger tubes may be cleaned. For example, after gross contamination or corrosion, cleaning may be required. In contrast to the exterior surfaces, a high degree of cleanliness is required for the interior of the heat exchanger tubes, which normally carry refrigerant.

According to the present invention, an ultrasonic transducer may be inserted in or directed toward the lumen one or more heat exchange tubes, to generate cavitation within the tube for the purpose of dislodging surface contaminants. There are known methods for ultrasonically cleaning tubes, and aspects of these methods may be employed herein. It is noted that, in general, the heat exchanger tubes of chiller evaporator have a higher aspect ratio than tubes for which ultrasonic cleaning has typically been applied. Practically, this means that an ultrasonic transducer probe is introduced into the lumen of each tube, and advanced. This may be guided by a camera or other positioning device, from a lateral side of a tube plate.

The ultrasonic tube lumen cleaning apparatus includes, for example, an ultrasonic generator and reflector each coupled to opposing ends of the open-ended, fluid-filled tube. Fluid-tight couplings seal the reflector and generator to the tube, preventing leakage of fluid from the interior of the tube. The reflector and generator are operatively connected to actuators, whereby the distance between them can be varied. When the distance is changed, the frequency of the sound waves is simultaneously adjusted to maintain the resonant frequency of the tube so that a standing wave is formed in the tube, the nodes of which are moved axially to cause cavitation along the length of the tube. Cavitation maximizes mechanical disruption and agitation of a solvent fluid, dislodging foreign material from the interior surface. The frequency of the sound emitted by the generator can be varied. The tube will inherently have one or more resonant frequencies.

To effectively clean the entire inner surface of the tube, the positions of the standing wave maxima and minima with respect to the tube must be moved. This is accomplished, preferably, by changing the distance between the sound reflector and sound generator, which would change the resonant frequency and the interior points at which cavitation effects are greatest, while varying the frequency of the generated wave so that the standing wave is maintained but the positions of the maxima and minima are moved. For most effective cleaning, the distance is changed several times, so that at the differing resonant frequencies cavitation-and cleaning action-is maximized at essentially every location along the inner surface of the tube.

The frequency modulation may be random or quasi random, or indeed amplitude modulation also generates frequency side bands. Hence the said effective random range of frequencies may be generated by either frequency modulation, amplitude modulation, or both, so long as the range of frequencies at any one point in the tank change fast enough to eliminate the chances of obtaining intense sound pressures persisting for more than the period required at the particular sound pressure, temperature and vapor pressure to cause significant levels of cavitation.

Optimum cleaning parameters are determined on an empirical basis for each application. For example, where a number of similarly-treated tubes must be cleaned, similar types and quantities of foreign material are expected to be found on the surfaces of all the tubes having a same general position. The appropriate operating limits, including distance and frequency ranges, duration, and power levels, are determined for one of the tubes, then implemented for each tube in succession. The frequency may require tuning with each distance adjustment.

An important feature of the present invention is the sound generator. The generator is preferably an ultrasonic horn or similar apparatus which is capable of providing sound in the appropriate frequency range (about 20 kHz–100 kHz) and sufficient power output (about 10 watts–5,000 watts, preferably about 10–500 watts).

A standing wave pattern set up by a reflector which ensures that the ultrasonic energy produced by the generator is distributed uniformly along the length of the tube, resulting in more uniform cleaning of the interior. The reflector is formed of any convenient sound-reflecting material, such as a metal plate. The surface of the reflector may be curved to facilitate setting up a standing wave pattern within the tube by focussing the reflected sound waves.

Cavitation may also occur in the absence of sound reflector. However, the intensity of the effect decreases with increasing distance from sound generator as the energy of waves is dissipated in fluid. Thus, cleaning is nonuniform throughout the length of tube. The standing wave pattern set up by use of reflector ensures that the energy produced by generator is distributed relatively uniformly along the length of tube, resulting in more uniform cleaning of interior.

Cavitation is maximized, and, therefore, cleaning is most effective at annuli. The axial positions of annuli must be varied to effectively clean the entire inner surface of tube. This can be done by varying the resonant frequency of tube, thereby changing the standing wave pattern and the relative positions of annuli. The effect is to move the same amount of cavitation. regions of low and high pressure along inner surface so that all interior points receive the

BRIEF DESCRIPTION OF THE DRAWINGS

The invention will now be described with reference to the accompanying drawings, in which.

DETAILED DESCRIPTION OF THE PREFERRED EMBODIMENTS

Figure 1:
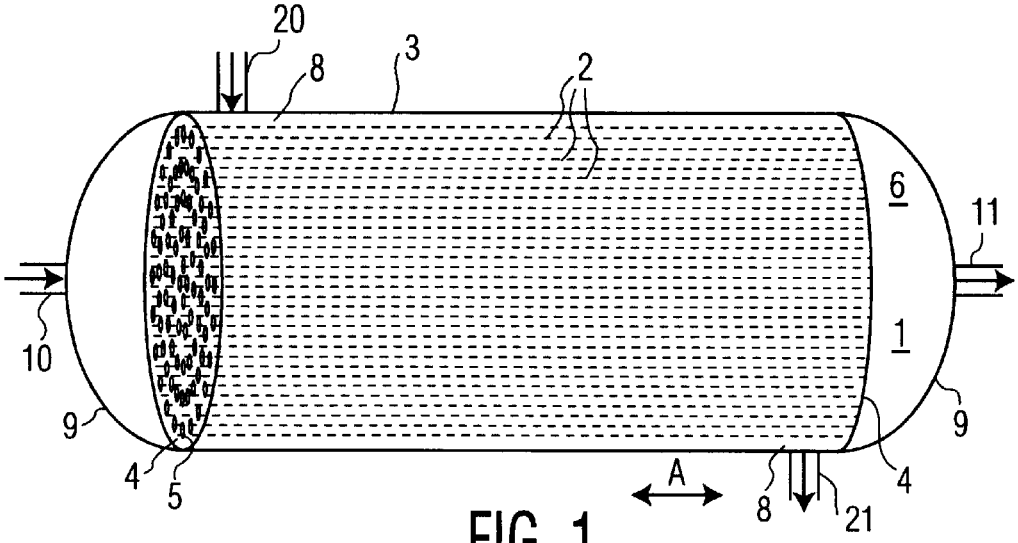
FIG. 1 is a schematic view of a known tube in shell heat exchanger.
Figure 2:
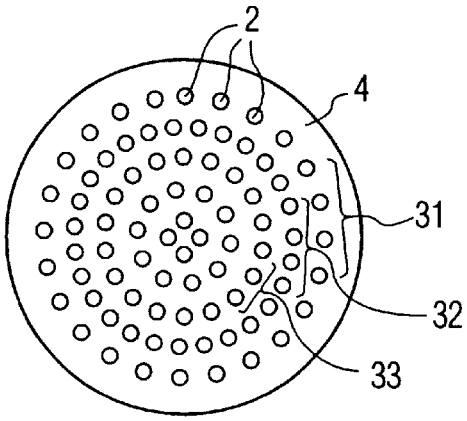
FIG. 2 shows an end view of a tube plate, showing the radially symmetric arrangement of tubes of a tube bundle, each tube extending axially along the length of the heat exchanger.
Figure 3:
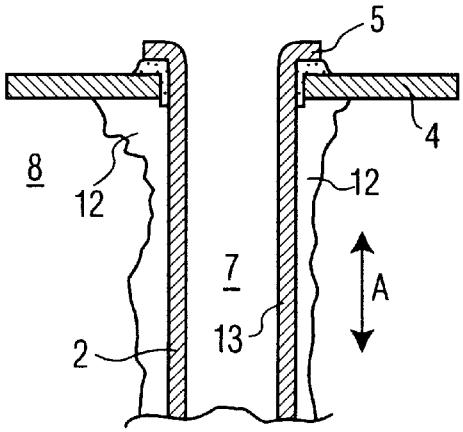
FIG. 3 shows a detail of the attachment of a tube to the tube plate, with a flared end brazed to the plate, and an accumulation of sediment on the outer surface of the tube.

The foregoing and other objects, features and advantages of the present invention will become more readily apparent to those skilled in the art to which the invention pertains upon reference to the following detailed description of one of the best modes for carrying out the invention, when considered in conjunction with the accompanying drawing in which preferred embodiments of the invention arc shown and described by way of illustration, and not of limitation, wherein:

As shown in FIGS. 1–3, a typical tube in shell heat exchanger 1 consists of a set of parallel tubes 2 extending through a generally cylindrical shell 3. The tubes 2 are held in position with a tube plate 4, one of which is provided at each end 5 of the tubes 2. The tube plate 4 separates a first space 6, continuous with the interior of the tubes 7, from a second space 8, continuous with the exterior of the tubes 2. Typically, a domed flow distributor 9 is provided at each end of the shell 3, beyond the tube sheet 4, for distributing flow of the first medium from a conduit 10 through the tubes 2, and thence back to a conduit 11. In the case of volatile refrigerant, the system need not be symmetric, as the flow volumes and rates will differ at each side of the system. Not shown are optional baffles or other means for ensuring optimized flow distribution patterns in the heat exchange tubes.

The tube plates 4 are configured to hold the tubes 2 in a generally radially symmetric pattern. Each tube 2 is typically flared and brazed to the tube sheet 4, to form a good seal. As shown in FIG. 3, after use, sediment 12 may build up on the outer surface of the tubes 2, reducing heat transfer efficiency.

In this type of system, the interior space of the tubes 7 are hermetically sealed from the exterior space 8. Thus, if the seal is breached at any point, contamination will occur, requiring removal of refrigerant, repair and recharging of the system with clean refrigerant. Since the external space 8 is typically aqueous, the breach will allow gross water contamination of the refrigerant in the interior space 7. If not repaired immediately, corrosion of the inner surfaces 13 of the tubes may occur, with possible precipitation of mineral deposits. Thus, in the event of such a breach, the refrigerant-containing portion of the system must at least be dried, and possibly cleaned as well. Cleaning the interior surfaces of the tubes 13 is qualitatively different than cleaning the exterior surfaces, and may be conducted by chemical methods or by inserting an ultrasonic transducer system in the tubes 2 and generating ultrasonic cavitational waves in the interior space 7. The transducer may be advanced along the length of the tube to clean the entire inner surface 13; however, this is quite time consuming and requires the probe be individually inserted in each tube 2 of the tube bundle, through the conduits 10, 11 (or a special access port, not shown).

Figure 4:
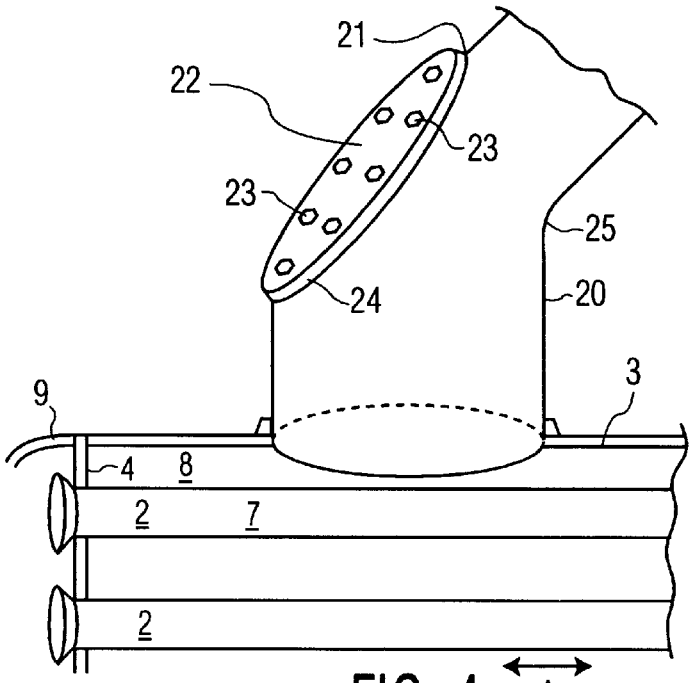
FIG. 4 shows a detail of a secondary heat exchange fluid connector to the shell according to the present invention, having a sealed access port for access to the exterior surfaces of the tubes.

As shown in FIG. 4, the conduits 20 leading to (and from 21) the exterior space 8 in the shell 3 are provided with an access port 21, which in this case is shown sealed with a cover plate 22. The cover plate 22 is bolted with bolts 23 in place with a gasket 24, to prevent leakage. Such cover plates 22 and seals 24 are well known. As shown, the proximal portion of the conduit 20 to the junction with the shell 3 is provided with an elbow 25, allowing relatively direct access into the shell 3 and the exterior space 8.

Figure 5:
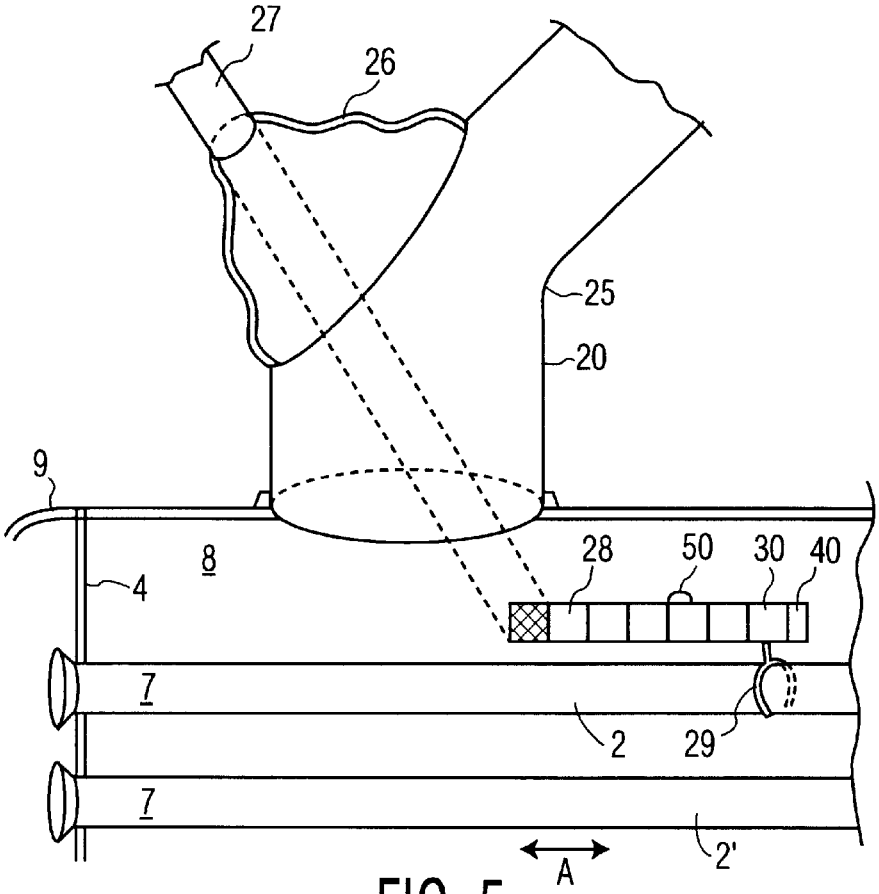
FIG. 5 shows a detail of a secondary heat exchange fluid connector to the shell according to the present invention, having an access port, surrounded by a boot, allowing an ultrasonic transducer to enter the fluid space for cleaning the exterior surfaces of the tubes.

FIG. 5 shows the cover plate 22 removed, and replaced with a rubber boot 26, through which a cable 27 extends. The cable 27 leads to a transducer array 28. The cable 27 is relatively rigid, and therefore allows the transducer array 28 to be advanced along the tubes 2 of the tube bundle by compression of the cable 27. A positioning guide 29, disposed on the transducer array 28, allows the transducer array 28 to be guided linearly along the tubes 2 of the tube bundle. Advantageously, a mechanism 30 allows the positioning guide 29 to radially displace the transducer array 28 to an adjacent tube 2' of the tube bundle, allowing treatment of the entire circumference of the tube bundle.

Because of the relatively large size of the transducer array 28 with respect to the diameter of each tube 2, ultrasonic energy will penetrate beyond the outermost tubular elements 31 to intermediate tubular elements 32 and inner tubular elements 33. By adjusting transducer excitation parameters, therefore, treatment of inner tubular elements 33 is possible. Further, since the shell 3 has two conduits 20, 21, transducer arrays 28 may be inserted in a respective access port for each conduit 20, 21, allowing interaction therebetween. Thus, acoustic wave patterns may be established within the shell 3 such that effective cavitation occurs proximate to the inner tubular elements 33 in the central portion of the tube bundle.

A sensor may 40 be provided in conjunction with the transducer array 28 to detect particulates and dissolved substances in the surrounding solvent. Therefore, the progress of the cleaning may be monitored and the transducer array 28 operated to clean tubes 2 in portions of the tube bundle until clean, as detected by diminished particulates and solutes emanating therefrom. After the diminution of cleaning effect is detected, the transducer excitation parameters may be altered, seeking to treat different tubes 2 or portions thereof of the tube bundle within the same projected area of the transducer array 28, or the transducer array 28 may be moved, wither by axial displacement along a tube 2 or by shifting to an adjacent tube 2'.

Figure 6:
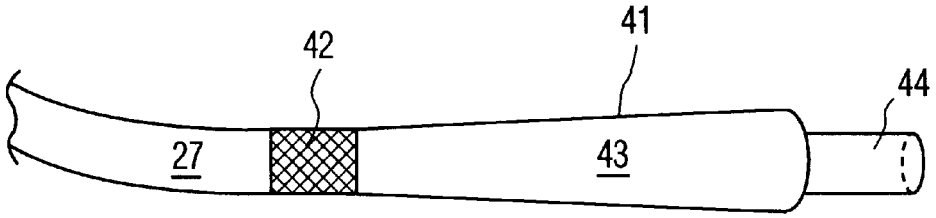
FIG. 6 shows a probe-type ultrasonic transducer for localized emission of ultrasonic waves.

FIG. 6 shows an ultrasonic transducer probe 41. A transducer cable 27 connects with the probe with a Fitting 42. The body 43 of the probe 41 contains a magnetostrictive transducer, which emits ultrasonic energy through a tip 44. The ultrasonic energy from the tip 44 is emitted generally omnidirectionally, and thus the maximum energy density will appear immediately adjacent to the tip 44. Therefore, in use, the tip 44 is placed at or near the site to be cleaned. Therefore, the probe is most useful for spot cleaning or cleaning inside tubes 2. When used to clean the exterior walls of a tube 2, the probe 41 may be useful for cleaning the areas near the junction of the tube 2 and tube sheet 4, and also exterior portions of the tubes 2 near the shell 3.

Figure 7:
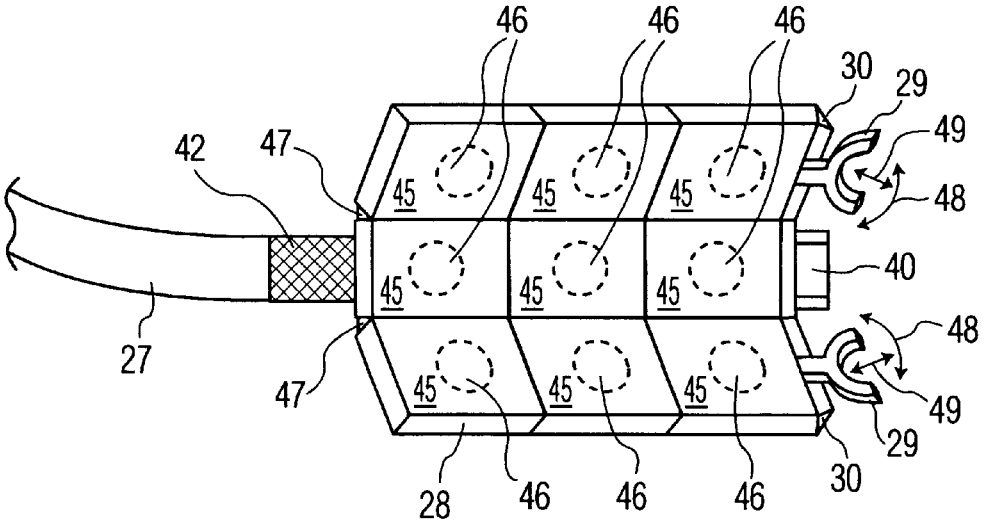
FIG. 7 shows an array of transducers, having a generally concave cylindrical configuration, and a positioning mechanism for selectively positioning the transducer array with respect to heat exchanger tubes.

FIG. 7 shows in greater detail an ultrasonic transducer array 28. A transducer cable 27 is provided with a fitting 42. This fitting 42 allows the transducer array 28 to be separated from the cable 27, and thus degradation of the cable 27 through, for example, repeated flexion, may be remedied. The transducer array 28 as shown includes a three-by-three array of rectangular transducer elements 45, each having a diaphragm portion 46. The transducer array 28 is flexible along junctures 47 between transducer array 28 elements 45 its lengthwise axis, allowing the transducer array 28 to conform to the space between the tubes 2 and heat exchanger shell 3. At the distal end of the transducer array 28 are provided a set of mechanical arms 29 adapted to hold the transducer array 28 displaced from tubes 2 of the tube bundle, but also to allow control over the radial placement of the transducer array 28 with respect to the tubes 2 of tube bundle. Through commands sent through the transducer cable 27, the mechanical arms 29 may be moved along, for example, two degrees of freedom, a rotation axis 48 with respect to the axis of the tube bundle and a displacement axis 49 with respect to the radial displacement from the tube 2. In this manner, the transducer array 28 may be repositioned around the tube bundle. The mechanical arms 29, when disposed in contact with the tubes 2 of the bundle, guide the transducer array 28 along the lengthwise axis A of the tube bundle, allowing relatively uniform treatment along the entire length of the heat exchanger 1. The cable 27 is relatively rigid, and therefore a compression of the cable 27 may be used to propel the transducer array 28 along the tubes 2 of the tube bundle.

A sensor system 40, including for example, a vision sensor, optical dispersion sensor, and/or electrolyte sensor, or the like is provided near the transducer array 28 to detect progress of the cleaning operation.

In order to accurately monitor the position of the transducer array 28 within the shell 3, an acoustic generator 50 (or mechanical-acoustic generator, such as a "tapper" for tapping against the shell, which may be activated by solenoid) produces a detectable sonic signal through the shell 3 at its location. This signal may be detected aurally (possible with augmentation through a stethoscope) or automatically. As the space between the tube bundle and shell is relatively narrow, the acoustic generator 50 may be in direct contact with the shell 3, thus easily localizing the position.

The foregoing description of the preferred embodiment of the invention has been presented for purposes of illustration and description and is not intended to be exhaustive or to limit the invention to the precise forms disclosed, since many modifications and variations are possible in light of the above teaching. Some modifications have been described in the specifications and others may occur to those skilled in the art to which the invention pertains.

What is claimed is:

1. A method for cleaning a tube-in-shell heat exchanger, comprising:

(a) removably inserting an ultrasonic transducer within the shell of the heat exchanger;

(b) providing a liquid medium within the shell of the heat exchanger;

(c) exciting the ultrasonic transducer to produce cavitational acoustic waves within the liquid medium;

(d) detecting a signal from the ultrasonic transducer to determine a position thereof; and (e) repositioning the ultrasonic transducer with respect to a tube within the heat exchanger.

2. The method according to claim 1, further comprising the step of providing an access port leading to tile space within the shell.

3. The method according to claim 1, further comprising the step of providing an access port in a conduit leading to the space within the shell.

4. The method according to claim 1, wherein the liquid medium comprises an aqueous solution.

5. The method according to claim 1, wherein the liquid medium comprises a refrigerant.

6. The method according to claim 1, wherein the liquid medium comprises a detergent solution.

7. The method according to claim 1, further comprising the step of, after cleaning the heat exchanger in the liquid medium, exchanging the liquid medium with a different liquid medium and ultrasonically cleaning the heat exchanger in the different medium.

8. The method according to claim 1, wherein the ultrasonic transducer comprises a probe.

9. The method according to claim 1, wherein the ultrasonic transducer comprises an array of ultrasonic transducer elements, emitting ultrasonic waves from a composite area large with respect to a diameter of a tube.

10. The method according to claim 1, further comprising the step of altering excitation parameters of the ultrasonic transducer during said exciting step.

11. The method according to claim 1, wherein said repositioning step comprises disposing a member for guiding the ultrasonic transducer along the length of a tube.

12. The method according to claim 1, wherein said repositioning step comprises activating a mechanism proximate to the ultrasonic transducer to displace the transducer between a first radial position with respect to a tube and a second radial position with respect to a tube.

13. The method according to claim 1, wherein a set of tubes are provided in a tube bundle, having a plurality of exterior tubes, wherein said ultrasonic transducer is proximate to a first exterior tube, wherein said repositioning step comprises relocating the ultrasonic transducer to be proximate to a second exterior tube.

14. The method according to claim 1, further comprising the step of analyzing the fluid medium to determine a progress of the cleaning.

15. The method according to claim 1, further comprising the step of analyzing the fluid medium to monitor cleaning, and controlling the excitation based on said analysis.

16. The method according to claim 1, further comprising the step of analyzing the fluid medium to monitor cleaning, and controlling the repositioning based on said analysis.

17. The method according to claim 1, further comprising the step of analyzing the fluid medium to monitor cleaning, and controlling the excitation and repositioning based on said analysis.

18. The method according to claim 1, further comprising the steps of providing distinct means for emitting a signal from the ultrasonic transducer and detecting the signal emitted from the signal emitting means to determine a position of the ultrasonic transducer.

19. The method according to claim 1, further comprising the steps of controlling said repositioning based on the determined position.

20. The method according to claim 1, further comprising the step of tapping on the shell proximate to the location ol the ultrasonic transducer.

21. The method according to claim 1 wherein the ultrasonic transducer comprises a phase array, further comprising the step of exciting the phased array to control a depth of cavitional ultrasonic energy.

22. A cleaning apparatus for a tube-in-shell heat exchanger, comprising:

(a) an ultrasonic transducer adapted for relocatable insertion into a shell of a heat exchanger;

(b) means for controlling an ultrasonic signal from the ultrasonic transducer;

(c) means for detecting a signal from the ultrasonic transducer to determine a position thereof; and (d) means for changing a position of the ultrasonic transducer with respect to the heat exchanger.

23. The apparatus according to claim 22, further comprising an access port leading to the space within the shell.

24. The apparatus according to claim 22, further comprising an access port in a conduit leading to the space within the shell.

25. The apparatus according to claim 22, further comprising means for circulating a liquid medium in the shell.

26. The apparatus according to claim 22, further comprising means for exchanging a liquid medium in the shell.

27. The apparatus according to claim 22, wherein said control means controls a sequence of cleaning operations.

28. The apparatus according to claim 22, wherein said ultrasonic transducer comprises a probe.

29. The apparatus according to claim 22, wherein said ultrasonic transducer comprises an array of ultrasonic transducer elements, emitting ultrasonic waves from a composite area large with respect to a diameter of a tube.

30. The apparatus according to claim 22, wherein said control means alters excitation parameters of the ultrasonic transducer.

31. The apparatus according to claim 22, wherein said means for changing position comprises a member for guiding the ultrasonic transducer along the length of a tube.

32. The apparatus according to claim 22, wherein said means for changing position comprises a mechanism proximate to the ultrasonic transducer to displace the transducer between a first radial position with respect to a tube and a second radial position with respect to a tube.

33. The apparatus according to claim 22, wherein said heat exchanger comprises a set of tubes provided in a tube bundle, having a plurality of exterior tubes, wherein said ultrasonic transducer is initially disposed proximate to a first exterior tube, wherein said means for changing position relocates the ultrasonic transducer to be proximate to a second exterior tube.

34. The apparatus according to claim 22, further comprising a sensor for analyzing the fluid medium to determine a progress of the cleaning.

35. The apparatus according to claim 22, further comprising means for analyzing the fluid medium to monitor cleaning, wherein said control means controls excitation of said ultrasonic transducer based on an output of said analyzing means.

36. The apparatus according to claim 22, further comprising means for analyzing the fluid medium to monitor cleaning, said control means controlling the means for changing position based on an output of said analyzing means.

37. The apparatus according to claim 22, further comprising means for emitting a signal detectable through the shell from the ultrasonic transducer.

38. The apparatus according to claim 22, further comprising means for emitting a signal from the ultrasonic transducer detectable through the shell means for detecting the signal emitted from the signal emitting means to determine a position of the ultrasonic transducer.

39. The apparatus according to claim 22, wherein said control means detecting a position of the ultrasonic transducer controlling said means for changing position based on the determined position.

40. The apparatus according to claim 22, wherein said ultrasonic transducer is associated with a means for tapping on the shell proximate to the location of the ultrasonic transducer.

41. The apparatus according to claim 22, wherein the ultrasonic transducer comprises a phase array, wherein said control means excites the phased array to control a depth of cavitional ultrasonic energy.

* * * * *